US011499335B2

(12) United States Patent
Hoggan

(10) Patent No.: US 11,499,335 B2
(45) Date of Patent: Nov. 15, 2022

(54) CHAIN LINK FENCE WITH INTERNALLY RETAINED SLATS AND METHOD OF MAKING THE SAME

(71) Applicant: Patrick R. Hoggan, North Logan, UT (US)

(72) Inventor: Patrick R. Hoggan, North Logan, UT (US)

(73) Assignee: PRIVACYLINK, LLC, Smithfield, UT (US)

( * ) Notice: Subject to any disclaimer, the term of this patent is extended or adjusted under 35 U.S.C. 154(b) by 0 days.

(21) Appl. No.: 14/973,441

(22) Filed: Dec. 17, 2015

(65) Prior Publication Data

US 2017/0328084 A1 Nov. 16, 2017

(51) Int. Cl.

| | |
|---|---|
| ***E04H 17/06*** | (2006.01) |
| ***E04H 17/16*** | (2006.01) |
| ***B21F 29/02*** | (2006.01) |

(52) U.S. Cl.

CPC ..... *E04H 17/066* (2013.01); *B21F 29/02* (2013.01); *E04H 17/16* (2013.01); *E04H 17/164* (2021.01)

(58) Field of Classification Search

CPC ..... E04H 17/02; E04H 17/06; E04H 17/066; E04H 17/16; E04H 17/161; E04H 17/164

See application file for complete search history.

(56) References Cited

U.S. PATENT DOCUMENTS

| | | | | |
|---|---|---|---|---|
| 2,760,759 | A | | 8/1957 | Rice |
| 2,802,645 | A | | 8/1957 | Rice |
| 3,069,142 | A | | 12/1962 | Kessler |
| 3,877,140 | A | * | 4/1975 | Topolsek ..... E04H 17/02 256/19 |
| 4,085,954 | A | | 4/1978 | Thompson |
| 4,183,993 | A | * | 1/1980 | Benstead ..... B29C 70/202 428/408 |
| 4,512,556 | A | * | 4/1985 | Meglino ..... E04H 17/066 256/24 |
| 4,725,044 | A | | 2/1988 | Cluff |
| 4,836,505 | A | | 6/1989 | Meglino |
| 5,056,761 | A | * | 10/1991 | Meglino ..... E04H 17/066 256/32 |
| 5,106,058 | A | * | 4/1992 | Finkelstein ..... E04H 17/066 245/11 |
| 5,275,381 | A | | 1/1994 | Cluff |
| 5,584,468 | A | | 12/1996 | Meglino |
| 5,775,676 | A | | 7/1998 | Hoggan |
| 5,794,922 | A | | 8/1998 | Meglino |
| 5,799,929 | A | | 9/1998 | Meglino |

(Continued)

FOREIGN PATENT DOCUMENTS

DE 20 2013 102 540 * 6/2013 ..... E04H 17/14

*Primary Examiner* — Michael P Ferguson

(74) *Attorney, Agent, or Firm* — Preston P. Frischknecht; Project CIP

(57) ABSTRACT

A chain link fence with retained slats including a chain link fence with two or more slats inserted into the fence, each slat haVing two opposing apertures bounding an internal channel and at least one band disposed through the internal channels so as to retain the slats within the chain link fence. Apertures may form cutouts in the slats. The band is flexible and inserted into the chain link fence before installation. The entire system is configured to be rolled and unrolled. A method of making the chain link fence with retained slats is also provided.

11 Claims, 8 Drawing Sheets

(56) References Cited

U.S. PATENT DOCUMENTS

| | | | | |
|---|---|---|---|---|
| 5,806,839 | A * | 9/1998 | Meglino | E04H 17/066 256/1 |
| 6,068,243 | A | 5/2000 | Hoggan | |
| 6,164,628 | A | 12/2000 | Hoggan | |
| 6,182,947 | B1 | 2/2001 | Meglino | |
| 6,634,623 | B2 | 10/2003 | Torres | |
| 6,966,547 | B2 | 11/2005 | Colliander | |
| 7,165,760 | B2 | 1/2007 | Campbell | |
| 7,237,766 | B2 | 7/2007 | Lemay | |
| 7,878,487 | B2 | 2/2011 | Pearson | |
| 8,366,078 | B2 | 2/2013 | Meglino | |
| 2014/0145133 | A1 | 5/2014 | McClure | |

* cited by examiner

CHAIN LINK FENCE WITH INTERNALLY RETAINED SLATS AND METHOD OF MAKING THE SAME

BACKGROUND OF THE INVENTION

Field of the Invention

This invention relates to slats which are inserted into chain link fences in order to increase privacy and security, and especially to the retention of such slats in a chain link fence.

Description of the Related Art

There are many patents for retaining, or locking, slats into a chain link fence.

These generally appear to fall into four major categories: (1) apertures in the sides of adjacent slats through which a retaining bar is placed; (2) a substantially U-shaped channel to receive an end of each slat placed at the bottom, the top, or both the bottom and the top of the slats; (3) a pin placed within and extending from each slat; and (4) fins extending from the sides of the slats to the knuckles of the fence, plus a fifth category of miscellaneous retaining devices.

In the first major category U.S. Pat. No. 4,512,556 has such a retaining bar, indeed, inserted through apertures in the slats. For U.S. Pat. No. 5,056,761 each slat is retained by one or more horizontal slats or strips intertwined in the fence wires and passed through aligned openings in the opposite sides of the slats; a strip can be unwound from a supply spool. (Although this could be inserted into a chain link fence, i.e., pre-inserted, prior to installation, or even shipment, of the fence and probably wound with the uninstalled fence for shipment, but such pre-insertion would be difficult because the apertures would have to be precisely aligned for all the slats. Moreover, such pre-insertion is nowhere stated in the patent to have been done. A similar slat-retaining fence using a strip placed through apertures in the slats is manufactured and offered for sale as the Top Lock Slat by Pexco of Atlanta, Ga.) In U.S. Pat. No. 5,106,058 a flexible belt (made from flexible material such as plastic, rubber, or the like) is horizontally inserted through apertures in the slats. For U.S. Pat. No. 5,584,468 slots (apertures) in slats receive a retaining bar. Slats having opposing slots (apertures) for receiving a retaining bar are the subject of U.S. Pat. No. 5,806,839. A support bar extends through opening in the slats of U.S. Pat. No. 6,182,947. And one embodiment for U.S. Pat. No. 6,966,547 involves an upper rail extending through apertures in slats.

Representative of the second major category, United States Patent Publication No. 2014/0145133 utilizes a U-shaped retainer having flanges to spring into cutouts in the slat. (The retainer is stated to be able to be at either the top or the bottom of the slats, but it is not indicated that a top retainer and a bottom retainer can be simultaneously employed. A second embodiment of U.S. Pat. No. 6,966,547 has sidewall on each slat which snaps into a retainer on the top, bottom, or both ends of the fence. Each slat in U.S. Pat. No. 7,878,487 has at least two notches on opposite faces into which barbs extend from the front and rear of the retaining channel; the retaining channel can be at the top or the bottom of the fence but is not stated to be simultaneously at the top and the bottom. Tabs on a U-shaped retaining bar at the bottom of the fence fit into apertures in the front and rear of the slats for U.S. Pat. No. 8,366,078. In a first variant of this major category U.S. Pat. No. 7,165,760 uses a retraining strip having protrusions, at least one of which fits into a notch near the bottom of each slat. In U.S. Pat. No. 4,085,954 a U-shaped retainer can support the slats from the bottom or be at the top or bottom or both of the slats but has no portion extending into any slat. And two examples of a second related variant exist. U.S. Pat. Nos. 2,760,759 and 2,802,645 are very similar to each other. Both involve slats that are supported by a horizontal slat or strip (or, in a different embodiment, attached to a rigid connecting member). Proper alignment of the slats within each retainer would, however, be very time consuming.

Within the third major category U.S. Pat. No. 4,725,044 has a pin which locks into a slat through an aperture and limits the movement of the slat with respect the wire of a fence or, in a second embodiment, can wrap around a bottom rail installed on the fence. A member having a stop to retain a slat is inserted into a slat of U.S. Pat. No. 5,794,922. And the claims of U.S. Pat. No. 5,799,929 seem to deal with third and fourth stops which are discussed but not claimed in U.S. Pat. No. 5,794,922. Installation of these pins would again require considerable time.

For the fourth major category U.S. Pat. No. 5,775,676 has fins which wedge into the knuckles of a fence; one embodiment also has strands, at the ends of the fins, to wrap around the knuckle. In U.S. Pat. No. 6,164,628 a first set and a second set of fins retain a slat in a chain link fence by engaging the knuckles of the fence. And a notch in a fin of a slat is intended to catch on a fence knuckle in U.S. Pat. No. 6,634,623.

For the miscellaneous category the one embodiment of U.S. Pat. No. 2,802,645 was noted above. Additionally, the slats of U.S. Pat. No. 3,069,142 are diagonally arranged, are attached to the wire of the fence with an integral clip, and are further retained with frictional force from slats that are perpendicularly diagonal to the other slats. In U.S. Pat. No. 4,836,505 a horizontal strip member is conventionally attached to the vertical slats; the strip member is made from any conventional materials, such as wood, metal, or extruded plastic. Picket members on one side of a chain link fence are, in U.S. Pat. No. 5,275,381 snappingly engaged with mounting members either woven into the fence or on the opposite side of the fence. An expandable corrugated slat of U.S. Pat. No. 6,068,243 uses spring force to retain such slat in the channel of a fence. In U.S. Pat. No. 7,237,766 projections from a cap fit into channels of adjacent slats. And in U.S. Pat. No. Re. 36,0385 each slat has a channel near one edge to retain the fence wire between adjacent knuckles and also has an attachable cover for such channel.

Notwithstanding this prior art, there is a significant absence in the industry of chain link fences with slat retention systems that optimize installation efficiency, through, for example, pre-installed retention-type configurations that allow the entire system to be rolled or unrolled. As explicitly mentioned above with respect to U.S. Pat. No. 5,056,761 none of the above patents indicates that pre-insertion occurs, and the inventor is aware of no chain link fence which is manufactured and marketed with the slats and retaining device pre-installed (outside if its own). In fact, U.S. Pat. No. 5,056,761 suggests the opposite by indicating, in lines 11 through 14 of column 3, "After installation, each slat 74 is held in place by one or more horizontally oriented retaining slats or strips 78 intertwined in the fence wires 42 and passed through aligned openings 80 in the opposite sides of the slats 74," as also does U.S. Pat. No. 5,584,468 by declaring, in lines 35 through 37 of column 1, "It is also desirable to provide an aesthetically pleasing fence insert which is readily installed into an existing chain link fence."

Also, the inventor has been involved with the manufacture of slats for chain link fences since 1992 and is unaware of any retaining device actually employed in a chain link fence which is more than approximately four feet long. Notably, even the patents employing a retaining member that is flexible (U.S. Pat. No. 5,106,058) or unwound from a supply spool (U.S. Pat. No. 5,056,761) do not state or illustrate that the retaining member would be more than approximately four feet long. Still, U.S. Pat. No. 5,056,761, in lines 17 through 19 of column 3, asserts, "In the size noted, strip 78 has the advantage of being supplied on a supply spool and unwound therefrom for long length installation"; and line 58 in column 3 of U.S. Pat. No. 6,966,547 states, "The slat retainer [which may be positioned along the bottom, the top, or both ends of a chain link fence] may have any desired length." Also, U. S. Patent Application No. 20140145133 indicates, "The [U-shaped] slat retainer 380 may have any desired or suitable length. Likewise, any number of the slat retainers 380 may be used." These statements in patent documents and the inventor's observation can be resolved only by understanding that one or ordinary skill in the art would, prior to the inventor's conceiving of the present invention not have desired a length longer than approximately four feet for such a retainer and would have considered four feet to be a "long length." This is understandable in view of the facts that pre-insertion of a slat retainer had not occurred prior to the present invention and that dealing with lengthy retainers in the field would be very difficult. Moreover, immediately after the quotation from U.S. Pat. No. 5,056,761 regarding a "long length installation," that patent provides, "Alternatively, lengths of flattened tubes 76 may, as shown in FIG. 9, be substituted for the flexible retaining strip 78."

In fact, difficulty with insertion constitutes one of the reasons which the inventor's experience causes him to believe has dissuaded anyone from previously developing the concept for, or the reality of, a chain link fence with pre-inserted slats.

Indeed, even when a retaining device for the slats is employed, a multitude of such reasons exist, including, but not necessarily limited to, the following: For the first category of retaining devices, i.e., apertures in the sides of adjacent slats through which a retaining bar is placed, it would be very difficult and time consuming to align the apertures in the various slats perfectly to permit the passage of the retaining bar though all the slats. Subsequent to insertion of the retaining bar the ends of such retaining bar could inadvertently withdraw from the apertures in one or more slats, thereby permitting such slats to drop lower than the remaining slats and causing the overall pre-inserted collection of slats to become non-uniform in appearance, creating an undesirable aesthetic effect. Slats have almost universally been a distinctly separate business from chain link fences; so, dealers and customers have become satisfied with buying these items separately and inserting the slats after the chain link fence has been installed. Many customers prefer to select the slat they desire and the fence they desire separately. And the added cost for pre-insertion has deterred innovation in this regard.

In lines 22 through 24 of column 2 U.S. Pat. No. 4,512,556 of Don A. Meglino asserts, "The leading end 5' of the retaining slat 5 is preferably tapered for easy insertion through the aperture 10 in the parallel slats." Such a retaining slat 5 is shown in the figures to have the very most extreme portion of the leading end 5' and to have the sides (sometimes termed "edges") of the retaining slat angled toward each other when seen in a plan view showing either face of the retaining slat 5. In Mr. Meglino's U.S. Pat. Nos. 5,806,839 and 6,182,947 such a "tapered" leading end is illustrated but not discussed.

But the inventor is unaware of any retention band in the prior art the first end (sometimes termed the "leading end") of which is tapered when seen from either side in an elevational view.

Furthermore, no prior art slat is known to the inventor to have the entrance to an internal passage beveled inward to guide the first end of a retention band into such entrance during insertion of such retention band.

Nor does the inventor know of any prior art having such an entrance that, when seen in a plan view showing either face of the retention band, is concave to facilitate insertion of a retention band into such entrance during insertion of such retention band.

BRIEF SUMMARY OF THE INVENTION

The chain link fence with retained slats of the present invention includes a chain link fence with two or more slats inserted into the fence, each slat having two or more opposing apertures bounding an internal channel, and at least one band disposed through the internal channels so as to retain the slats within the chain link fence. Moreover, the band is flexible and the entire system is configured to be rolled and unrolled. In one embodiment, the apertures, interior channel and/or channels incorporate one or more concavities curved inward with respect to a side or sides of the slat resulting in circular or elliptical apertures. Embodiments may also use: beveled apertures; interior channel, and/or channels; bands with tapered ends; and various other features for optimizing installation. Finally, the invention includes a method of making the chain link fence with retained slats.

BRIEF DESCRIPTION OF THE SEVERAL VIEWS OF THE DRAWING

To further clarify the above and other aspects of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The drawings may not be drawn to scale. The invention will be described and explained with additional specificity and detail through the use of the accompanying drawings in which.

DETAILED DESCRIPTION OF THE INVENTION

Figure 1:
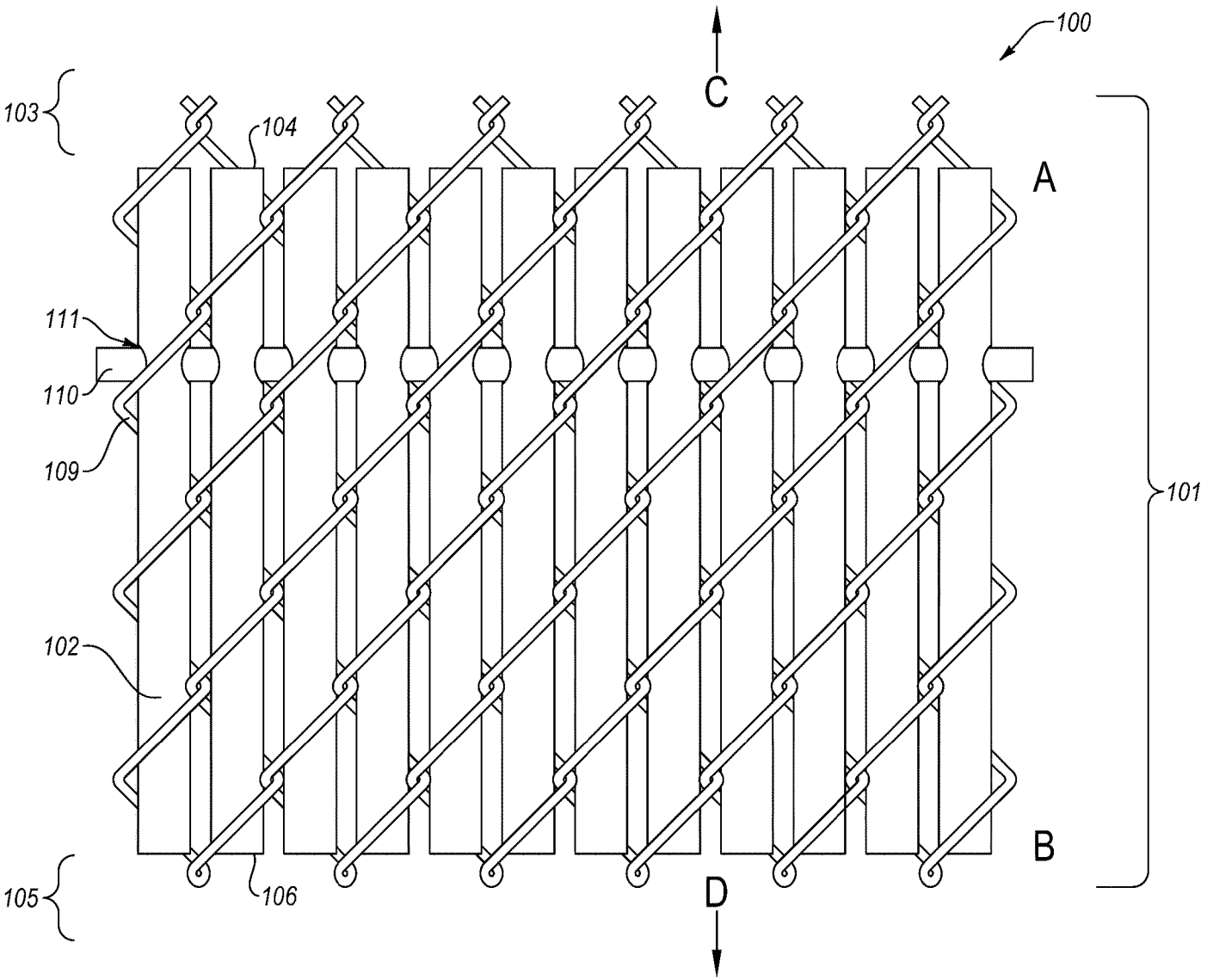
FIG. 1 is a front view of a chain link fence with retained slats.

Referring to FIG. 1, the chain link fence with internally retained slats comprises a traditional chain link fence 101 with fence slats 102 inserted into the chain link fence 101 and generally running from the top A to the bottom B of the chain link fence 101. Each fence slat 102 is constructed to accept at least one band 110 (which band 110 may, itself, be a single elongate element or a combination of elongate elements) into and running transversely across the interior 111 of the slat 102. The slat 102 may have any cross-sectional shape which is known in the art, such as rectangular, circular, and/or elliptical. The slats 102 and the at least one band 110 are inserted into the chain link fence 101 before the chain link fence 101 is installed, i.e., the slats 102 and the at least one band 110 are pre-inserted into the chain link fence 101.

Figure 2:
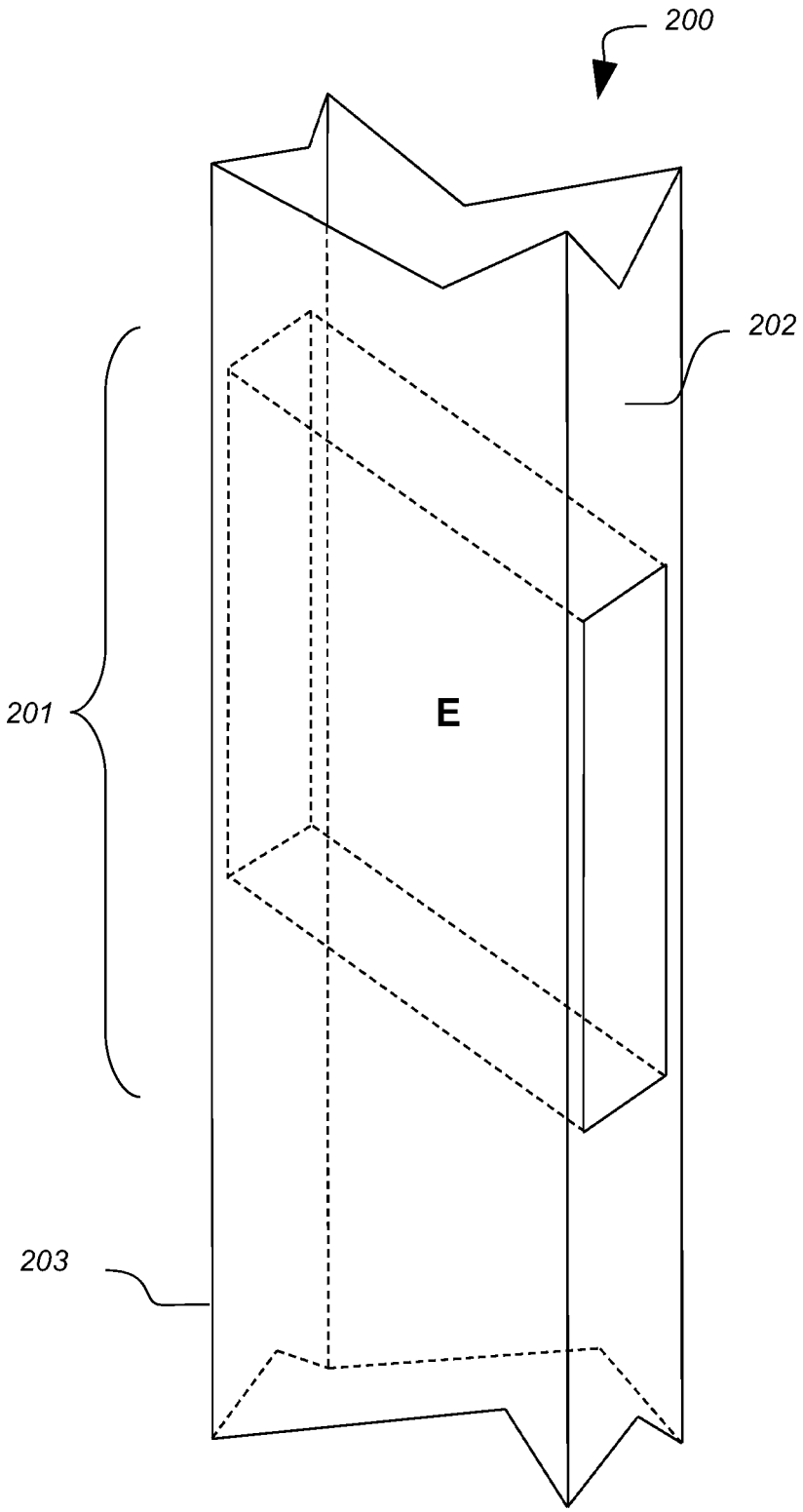
FIG. 2 is a perspective, partial section view of a first slat with apertures and an interior channel.
Figure 3:
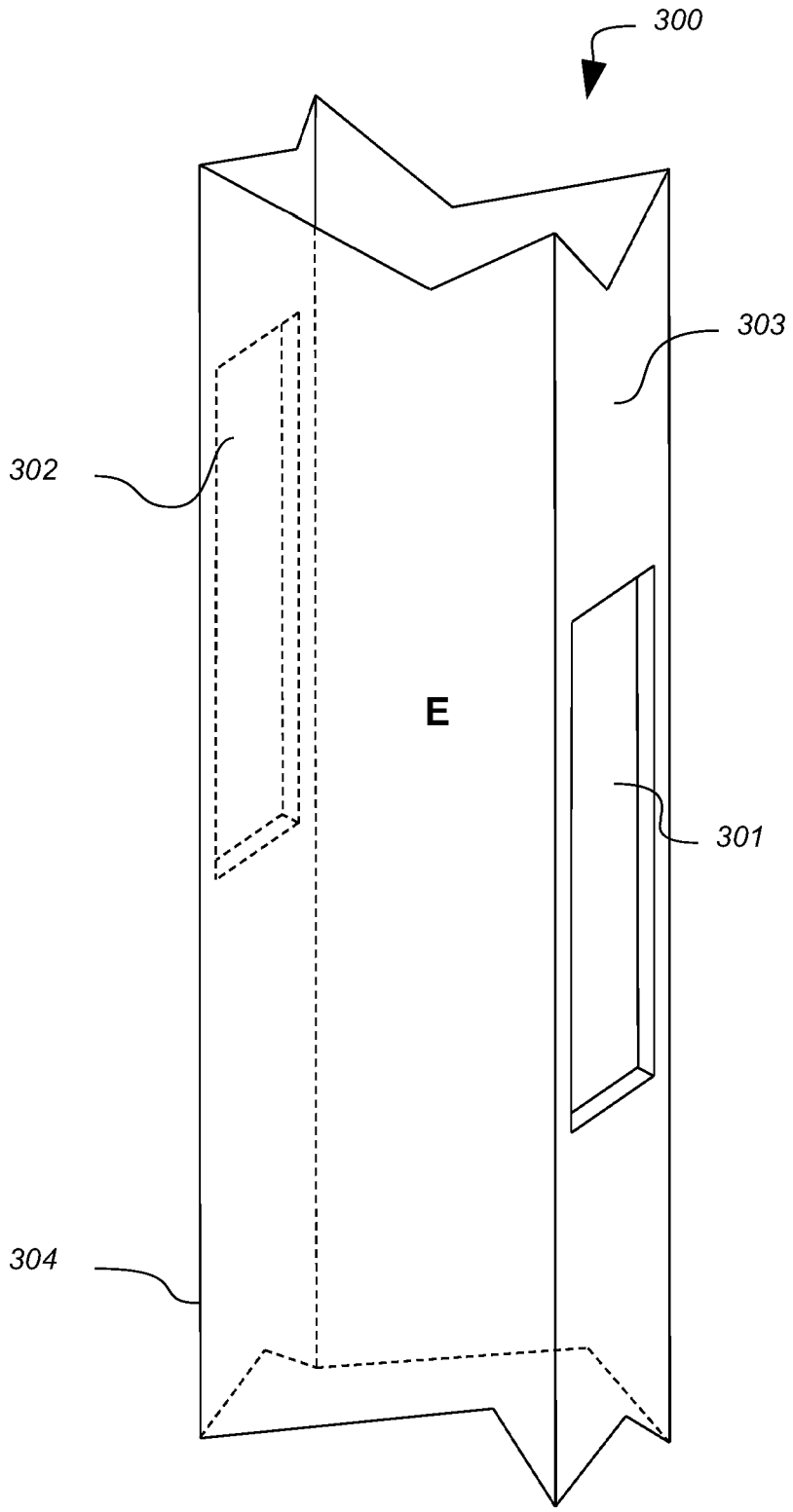
FIG. 3 is a perspective, partial section view of a first slat with apertures and an interior channel.

Referring now to FIG. 2, an exemplary solid slat 200 contains an interior channel 201 and/or E running between a first side 202 and a second side 203 of the slat 200. Another embodiment for an exemplary hollow slat 300 is shown in FIG. 3. Slat 300 contains a first aperture 301 on a first side 303 to accept for entry and/or egress a first end 501 of the band 110 (see FIGS. 5-10); and the second side 304 of the slat 300 contains a second aperture 302, also to accept the first end of the band 501 for entry and/or egress. Where multiple slats are employed within the chain link fence with retained slats. The apertures, interior channel, and/or channels of each slat are preferably located at substantially the same horizontally centered and elevational/vertical position so that a given band can run centrally through the corresponding apertures, interior channel, and/or channels of a plurality of parallel-linear oriented slats. In the illustrated embodiment of FIGS. 1, 4, and 13, each slat has a front and back outermost profile (or outline), the apertures bound an internal channel perpendicular to the slat, and the apertures form a narrowing of the outermost elevational profile, for example, through substantially continuously curving cutouts of the outermost elevational profile. Apertures of adjoining slats may form interstices 112 between slats at the front and back sides of the fence adjacent to slat narrowings. The band 110 may be disposed within the interstices to form a structure that allows the entire fence to be rolled and unrolled on each of the front and back sides of the fence.

Figure 4:
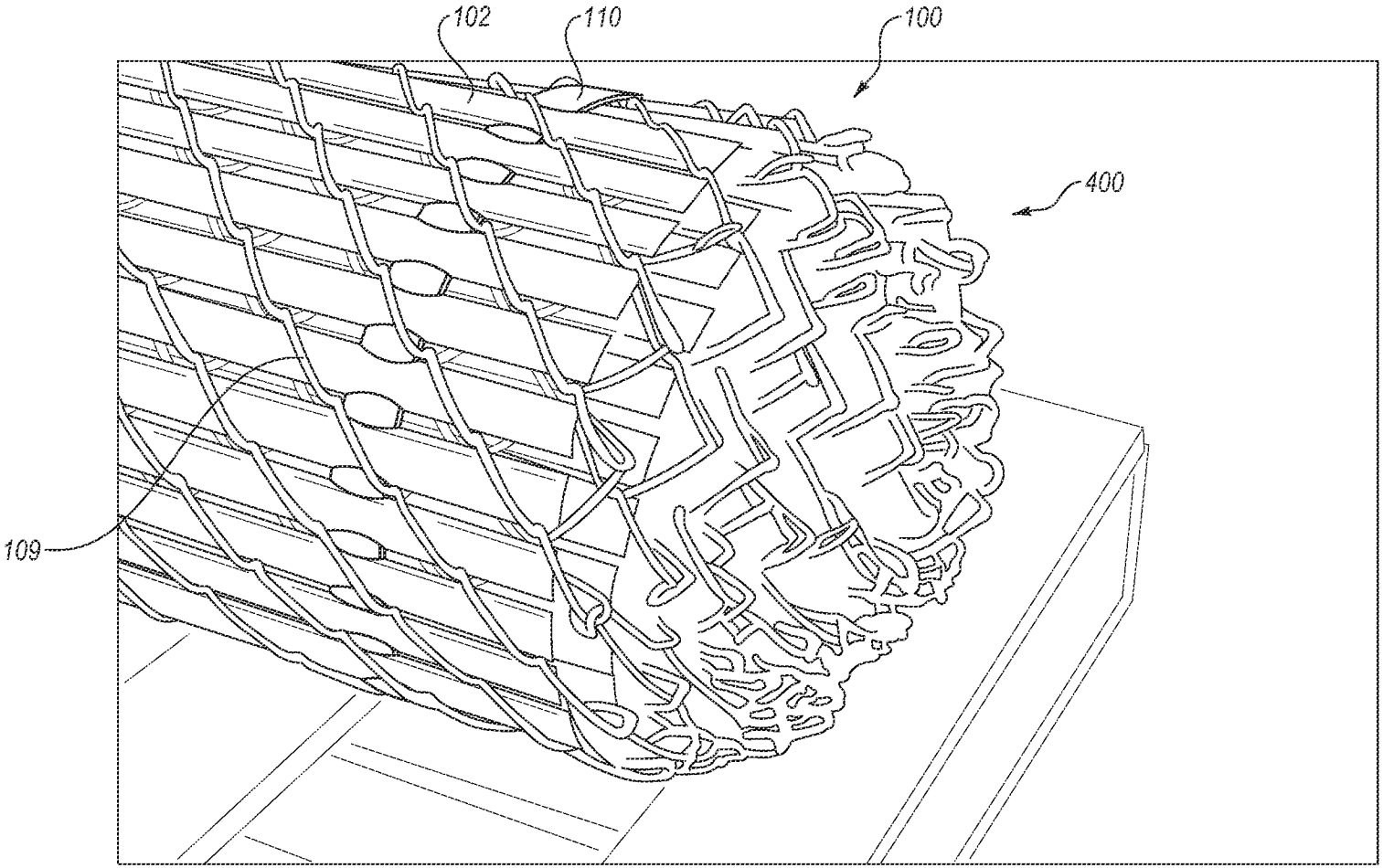
FIG. 4 is a perspective view of the chain link fence with retained slats in a rolled configuration.

Referring briefly back to FIG. 1, the one or more bands 110 has, as earlier observed, sufficient strength to retain slats 102 within the chain link fence 101 while also being sufficiently flexible to permit the chain link fence 101 with the pre-inserted slats 102 and band or bands 110 to be rolled and/or unrolled in the traditional manner for a chain link fence, as depicted in FIG. 4. To help accomplish this, band or bands 110 can be constructed of any material sufficient to create the preceding characteristics but is preferably composed of high-density polyethylene (HDPE). One non-exclusive alternative material is low-density polyethylene (LDPE). Band or bands can be of any desired length but are preferably one of standard lengths for a chain link fence, such as, for example, twenty-five feet or fifty feet.

As set forth herein, the invention may also include a method of making a fence with retained slats according to the fence, slat, and/or band specifications set forth herein. Such method may include the steps of: providing a chain link fence; providing fence slats, each slat having two opposing apertures bounding an internal channel; inserting the fence slats into the chain link fence; providing an elongate band; and inserting the elongate band through the fence slat apertures. As the fence with retained slats is intended in some embodiments as a pre-installed system, the method may further include the step of installing the fence at a property including after the other abovementioned steps.

Figure 5:
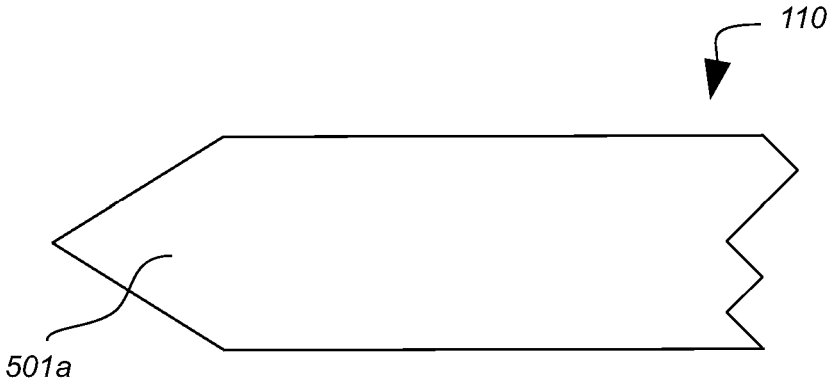
FIG. 5 is a plan view of a first band for retaining slats.
Figure 6:
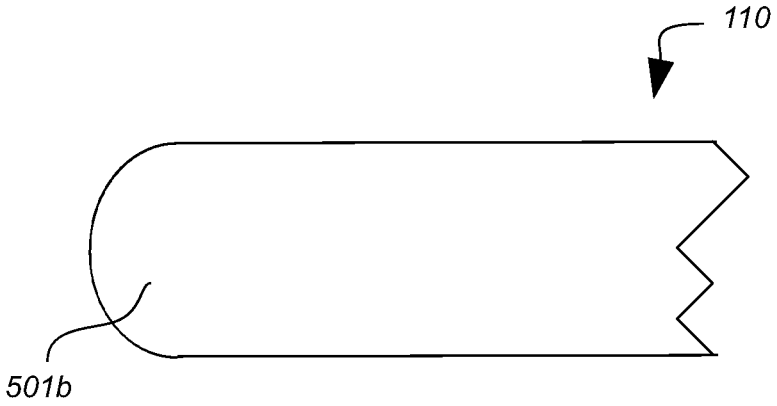
FIG. 6 is a plan view of a second band for retaining slats.
Figure 7:
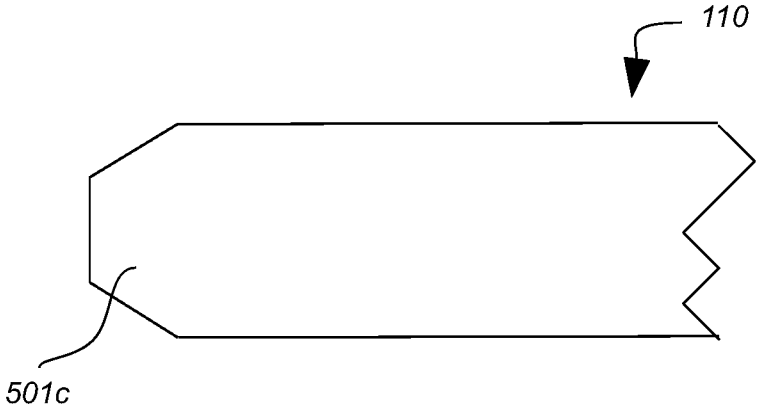
FIG. 7 is a plan view of a third band for retaining slats.

A number of features may be incorporated in order to facilitate placement of a band or bands into a slat or slats. Referring now to FIGS. 5-7, to facilitate insertion of a band 110 into the interior channel and/or apertures of a slat or slats, the first end 501 of a band 110 is preferably tapered when observed in a plan view looking at either a face (also called the front) or the back (also called the rear) of the band 110. For example, the first end 501 may be pointed (FIG. 5); curved (FIG. 6); or truncated (FIG. 7).

Figure 8:
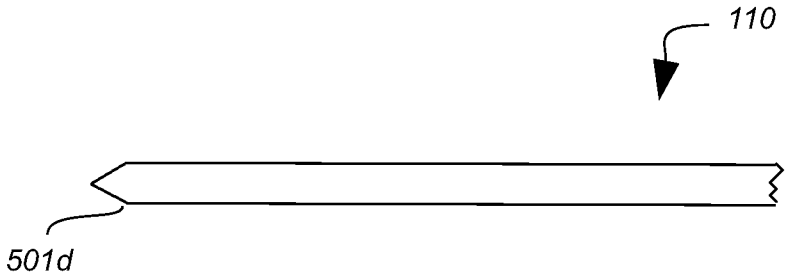
FIG. 8 is an elevational view of a fourth band for retaining slats.
Figure 9:
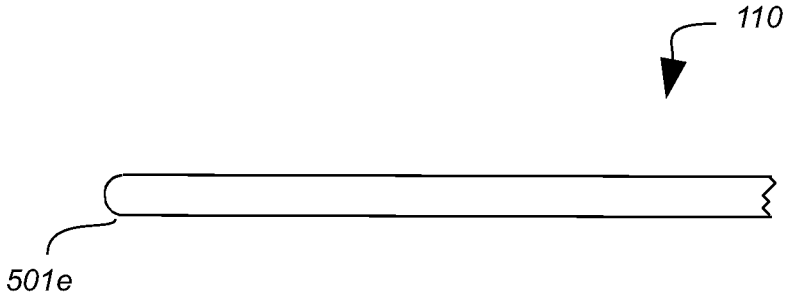
FIG. 9 is an elevational view of a fifth band for retaining slats.
Figure 10:
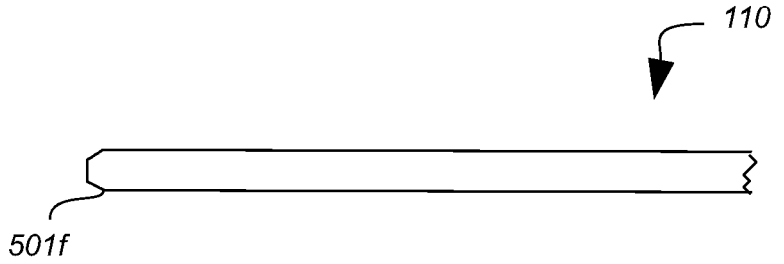
FIG. 10 is an elevational view of a sixth band for retaining slats.

Referring to FIGS. 8-10, to further facilitate insertion of a band 110 into the apertures, interior channel, and/or channels of a slat or slats, the first end 501 of a band 110 is preferably tapered when observed in an elevational view looking at either side of the band 110. For example, the first end 501 may be pointed (e.g., FIG. 8); curved (e.g., FIG. 9); or truncated (e.g., FIG. 10). Tapered band ends, as set forth above, create angles that guide the band into the slat into interior channel, channels, and/or apertures and also result in a smaller surface area for minimizing potential insertion obstructions with slat surfaces. The band configurations set forth above are exemplary only, and any other shaped band end 501 that facilitates placement of the band 110 within a slat or slats may be employed without departing from the purposes or scope of the invention.

Figure 11:
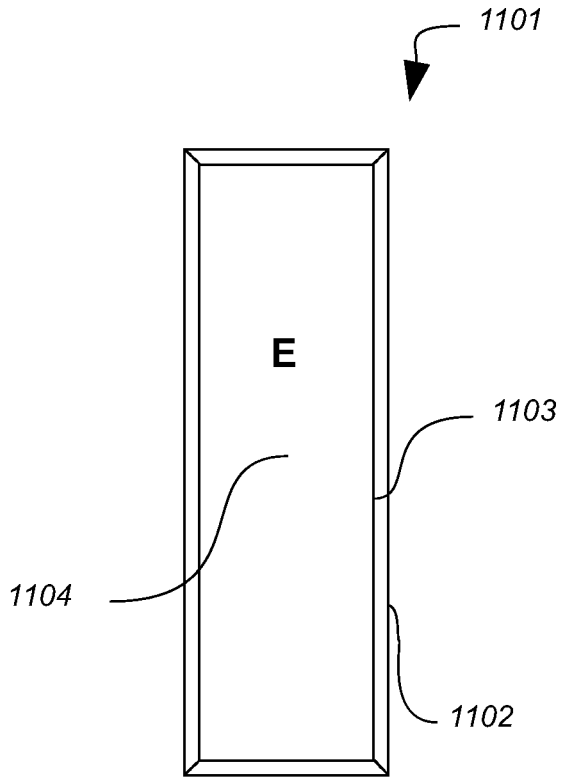
FIG. 11 is a plan view of a first beveled aperture of a slat.
Figure 12:
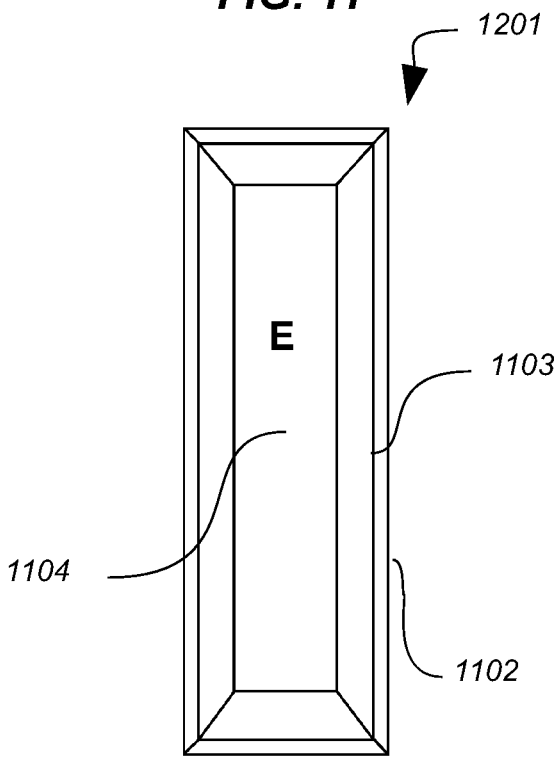
FIG. 12 is a plan view of an apertures and an interior channel of a slat with beveled entry.

Referring now to FIGS. 11-12, to facilitate insertion of a band 110 into the apertures, interior channel, and/or channels of a slat or slats, the first and/or second aperture 1101, as illustrated in FIG. 11, or the entry to and/or egress from 1201 the interior channel E, as shown in FIG. 12, is beveled, i.e., the outer perimeter 1102 is farther from the middle 1104 of the interior of the slat than is the inner perimeter 1103. Beveling on the apertures, interior channel, and/or channels of a slat or slats, and particularly beveling on these features on both sides of a slat, optimizes installation by avoiding the need to install the band from exclusively one side of the fence.

Figure 13:
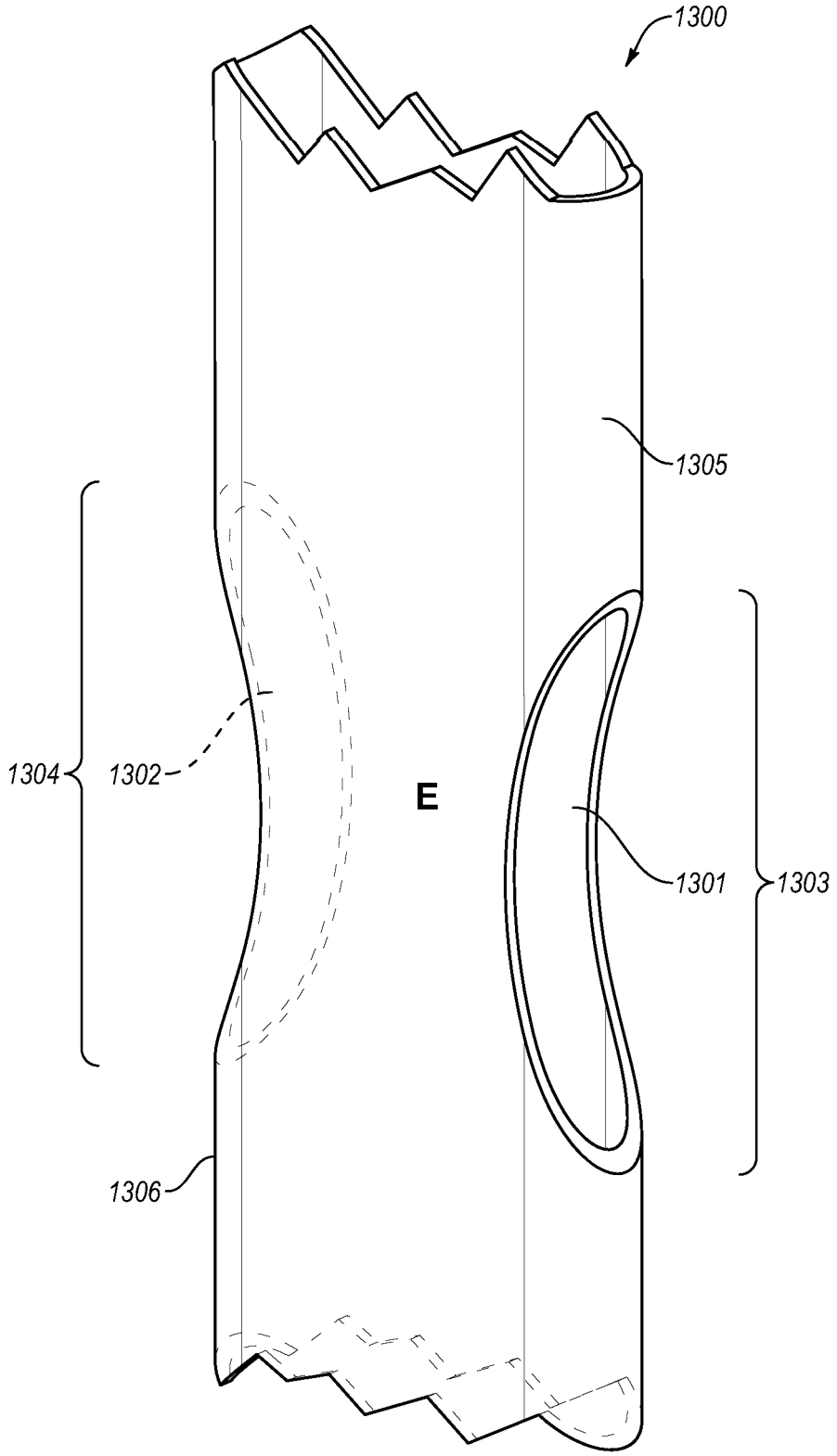
FIG. 13 is a perspective, partial section view of a second slat with apertures and an interior channel.

Referring now to FIG. 13, yet another embodiment for facilitating the insertion of a band 110 into the apertures, interior channel, and/or channels of a slat or slats includes an aperture or apertures 1301, 1302 with one or more concavities 1303, 1304 curved inward with respect to a side or the sides 1305, 1306 of the slat 1300 resulting in a circular or elliptical apertures. This embodiment is also shown in FIG. 1. So shaped, slat apertures 1301, 1302 act as funnels for directing the band into the slat. Across such embodiments, when inserted in a slat, band 110 is configured to be bounded on opposing sides by concave edges or concavities. Concavities may be present on one or both sides of the slat. Concavities on opposing sides are preferable to avoid the need to install the band from exclusively one side of the fence.

As set forth herein, the invention may also include a method of making a fence with retained slats according to the fence, slat, and/or band specifications set forth herein. Such method may include the steps of: providing a chain link fence; providing fence slats, each slat having two opposing apertures bounding an internal channel; inserting the fence slats into the chain link fence; providing an elongate band; and inserting the elongate band through the fence slat apertures. As the fence with retained slats is intended in some embodiments as a pre-installed system, the method may further include the step of installing the fence at a property including after the other abovementioned steps.

Thus configured, a chain link fence with retained slats is provided that optimizes installation efficiency through a pre-installed, retention-type configuration that allows the entire system to be rolled or unrolled.

As used herein, the term "substantially" indicates that one skilled in the art would consider the value modified by such terms to be within acceptable limits for the stated value. Also as used herein the term "preferable" or "preferably" means that a specified element or technique is more acceptable than another but not that such specified element or technique is a necessity. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

I claim:

1. A rolled pre-assembled chain link fence with retained slats, comprising:

a chain link fence panel having a top, a bottom, a front side, and a back side;

a plurality of fence slats inserted into the chain link fence panel generally from one or more of and perpendicular to the top and the bottom, each slat of the plurality of fence slats comprising a tubular body having opposing longitudinally-extending front and back faces having a width defining an outermost profile of the slat, opposing longitudinally-extending sides faces, and two opposing apertures extending through the sides faces of the slat and bounding an internal channel perpendicular to the slat, each of the two opposing apertures having a peripheral shape defining a concave cutout which extends into the front and back faces of the slat and forms a narrowing of the outermost profile of the slat, the apertures of adjacent slats being aligned to form interstices between the adjacent slats; and a flexible band longitudinally extending through the internal channel of each slat of the plurality of fence slats at slat centers to retain the plurality of fence slats within the chain link fence panel;

wherein the flexible band is configured to bend within the interstices to enable the pre-assembled chain link fence with retained slats to be rolled on each of the front and back sides for shipping prior to installation of the chain link fence.

2. The chain link fence with retained slats of claim 1, comprised substantially of unwinged slats.

3. The chain link fence with retained slats of claim 1, wherein one or more of the two opposing apertures forms a substantially continuously curving cutout.

4. The chain link fence with retained slats of claim 1, wherein each of the two opposing apertures forms a substantially continuously curving cutout.

5. A rolled pre-assembled chain link fence with retained slats, comprising:

a chain link fence panel having a top, bottom, a front side, and a back side;

a plurality of unwinged fence slats inserted into the chain link fence panel generally from one or more of and perpendicular to the top and the bottom, each unwinged fence slat of the plurality of unwinged fence slats comprising a tubular body having opposing longitudinally-extending front and back faces having a width defining an outermost profile of the slat, opposing longitudinally-extending sides faces, and two opposing apertures extending through the sides faces of the slat and bounding an internal channel perpendicular to the slat, each of the two opposing apertures having a peripheral shape defining a cutout with a concave edge which extends into the front and back faces of the slat and forms a narrowing of the outermost profile of the slat, the apertures of adjacent slats being aligned to form interstices between the adjacent slats; and a flexible band longitudinally extending through the internal channel of each slat of the plurality of fence slats at slat centers to retain the plurality of fence slats within the chain link fence panel;

wherein the flexible band is configured to bend within the interstices to enable the pre-assembled chain link fence with retained slats to be rolled on each of the front and back sides for shipping prior to installation of the chain link fence.

6. The chain link fence with retained slats of claim 5, wherein one or more of the two opposing apertures forms a substantially continuously curving cutout.

7. The chain link fence with retained slats of claim 5, wherein each of the two opposing apertures forms a substantially continuously curving cutout.

8. The chain link fence with retained slats of claim 5, wherein an end of the flexible band is tapered.

9. A method of making a pre-assembled chain link fence with retained slats, comprising the steps of:

providing a chain link fence panel having a top, a bottom, a front side, and a back side;

providing a plurality of fence slats, each slat comprising a tubular body having opposing longitudinally-extending front and back faces having a width defining an outermost profile of the slat, opposing longitudinally-extending side faces, and two opposing apertures extending through the sides faces of the slat and bounding an internal channel perpendicular to the slat, each of the two opposing apertures having a peripheral shape defining a concave cutout which extends into the front and back faces of the slat and forms a narrowing of the outermost profile of the slat;

inserting the fence slats into the chain link fence panel from one or more of and perpendicular to the top and the bottom, the apertures of adjacent slats being aligned to form interstices between the adjacent slats;

providing a flexible elongate band; and inserting the flexible elongate band through the fence slat apertures of each slat of the plurality of fence slats at slat centers to retain the slats within the chain link fence panel;

wherein the flexible band is configured to bend within the interstices to enable the fence to be rolled on each of the front and back sides for shipping prior to installation of the chain link fence; and rolling the pre-assembled chain link fence for shipping prior to installation of the fence.

10. The method of making a pre-assembled chain link fence with retained slats of claim 9, further comprising the step of installing the fence at a property.

11. The method of making a pre-assembled chain link fence with retained slats of claim 9, further comprising the step of unrolling the chain link fence prior to installation thereof.

* * * * *